US010165848B2

(12) United States Patent
Danforth

(10) Patent No.: US 10,165,848 B2
(45) Date of Patent: Jan. 1, 2019

(54) SLIP BELT CARRYING APPARATUS

(71) Applicant: FORESHORE TRAM & MOORAGE LTD., Kelowna (CA)

(72) Inventor: Wayne Danforth, Kelowna (CA)

( * ) Notice: Subject to any disclaimer, the term of this patent is extended or adjusted under 35 U.S.C. 154(b) by 0 days.

(21) Appl. No.: 15/806,320

(22) Filed: Nov. 7, 2017

(65) Prior Publication Data

US 2018/0140077 A1 May 24, 2018

Related U.S. Application Data

(63) Continuation-in-part of application No. 15/356,917, filed on Nov. 21, 2016, now abandoned.

(51) Int. Cl.

| | |
|---|---|
| ***A45F 5/00*** | (2006.01) |
| ***A45F 5/02*** | (2006.01) |
| ***A45F 3/14*** | (2006.01) |

(52) U.S. Cl.

CPC ..... *A45F 3/14* (2013.01); *A45F 5/021* (2013.01); *A45F 2003/144* (2013.01); *A45F 2003/146* (2013.01)

(58) Field of Classification Search

CPC ..... A45F 5/021; A45F 2003/144
USPC ..... 224/195, 251, 150; 206/316.2, 594, 592
See application file for complete search history.

(56) References Cited

U.S. PATENT DOCUMENTS

| | | | | |
|---|---|---|---|---|
| 162,055 A | | 4/1875 | Goss | |
| 775,149 A | * | 11/1904 | Righton | A45F 5/02 224/195 |
| 833,911 A | | 10/1906 | Bate | |
| 1,589,315 A | | 6/1926 | Johnston | |
| 1,601,624 A | * | 9/1926 | Houghton | A45F 5/00 224/195 |
| 1,642,046 A | * | 9/1927 | Sauer | A41F 9/002 112/417 |
| 1,968,767 A | | 7/1934 | Howard | |
| 2,496,748 A | | 6/1947 | Pond | |
| 3,004,519 A | | 10/1961 | Weissman | |
| 3,006,645 A | | 10/1961 | Frazier | |
| 3,072,166 A | | 1/1963 | Von Buchholtz et al. | |
| 3,721,216 A | | 3/1973 | Lippe et al. | |
| 3,726,616 A | | 4/1973 | Powers | |
| 3,743,147 A | | 7/1973 | Wilczynski | |
| 3,868,786 A | * | 3/1975 | Lippe | A01K 27/001 446/28 |
| 3,910,470 A | | 10/1975 | Swenson et al. | |
| 4,177,894 A | | 12/1979 | Petersen | |
| 4,330,073 A | | 5/1982 | Clark | |

(Continued)

FOREIGN PATENT DOCUMENTS

| | | |
|---|---|---|
| CA | 1108096 | 9/1981 |
| FR | 2447694 | 2/1979 |
| WO | 2005107512 | 11/2005 |

*Primary Examiner* — Justin Larson
(74) *Attorney, Agent, or Firm* — Richard D. Okimaw

(57) ABSTRACT

An apparatus for suspending a plurality of articles from a user having a torso comprising a belt securable around a mid-torso of the user and an inner stationary flexible member suspended beneath the belt and extending completely around a lower torso of the user. The apparatus further comprises an outer rotary flexible member suspended from and rotatable about the inner stationary flexible member, the outer rotary flexible member extending at least partially around the torso of the user and being operable to attach a plurality of objects thereto.

15 Claims, 8 Drawing Sheets

(56) References Cited

U.S. PATENT DOCUMENTS 4,383,565 A 5/1983 Denmat
4,433,803 A * 2/1984 Liberboim ..... A63B 47/001 224/251
4,681,225 A 6/1987 Schuster
4,704,001 A 11/1987 Parandes
5,316,146 A * 5/1994 Graff ..... B01L 9/06 206/438
5,356,004 A 10/1994 Weinreb
5,372,786 A * 12/1994 Iles ..... B01L 9/06 206/562
5,373,980 A 12/1994 Rowell et al.
5,407,640 A * 4/1995 Iles ..... B01L 9/06 206/562
5,570,780 A 11/1996 Miller
5,687,874 A 11/1997 Omori et al.
5,722,576 A 3/1998 Rogers
5,881,933 A * 3/1999 Rogers ..... A41F 9/02 224/195
5,941,438 A * 8/1999 Price ..... A41F 9/002 224/660
5,985,219 A * 11/1999 Lind ..... B01L 9/06 422/562
7,762,440 B2 * 7/2010 Cook ..... F41C 33/046 2/338
7,950,554 B2 * 5/2011 Hoffner ..... A45F 5/02 224/222
8,011,545 B2 * 9/2011 Murdoch ..... A45F 5/02 224/672
8,029,199 B1 10/2011 Kimball
8,281,923 B2 10/2012 Elenes
8,424,680 B2 4/2013 Fair et al.
8,510,868 B2 * 8/2013 Mongan ..... F41C 33/046 2/300
8,985,411 B2 * 3/2015 Mongan ..... A45F 5/021 224/195
9,629,398 B2 * 4/2017 Goryl ..... A41D 13/0012
2002/0096545 A1 7/2002 Chang
2003/0110550 A1 * 6/2003 Guibord ..... A41F 9/002 2/312
2004/0226972 A1 * 11/2004 Cook ..... A45F 5/021 224/195
2009/0302076 A1 12/2009 Romano et al.
2011/0240705 A1 10/2011 Landano
2012/0055822 A1 3/2012 Bullock
2016/0051037 A1 2/2016 Ballard

* cited by examiner

SLIP BELT CARRYING APPARATUS

CROSS-REFERENCE TO RELATED APPLICATION(S)

The present application is a continuation in part of, and is related to and claims priority to, pending U.S. Non-Provisional patent application Ser. No. 15/356,917, filed Nov. 21, 2016, entitled "Slip Belt Carrying Apparatus", which is incorporated by reference herein in its entirety.

BACKGROUND OF THE INVENTION

1. Field of Invention

The present invention relates generally to a method and apparatus for carrying articles, and in particular to a harness and belt system onto which containers may be attached, with the belt permitting relative rotational movement between the wearer and the containers.

2. Description of Related Art

In a variety of employment and hobby activities, it is desirable to have a number of objects close at hand and carried on the user for ready access. Examples of such activities include tradesmen carrying tools, police or military personnel carrying weapons and ammunition, safety personnel carrying first aid and triage equipment, and photographers carrying camera equipment and accessories.

One method of carrying objects is to attach the objects to a belt secured onto the user. Other belt carrying systems have been described, but lack flexibility with the attached objects located at one or more fixed locations around the user. Examples of these carrying systems include U.S. Pat. No. 3,762,616 (Brunstetter), US Patent Application Publication No. 2002/0096545 A1 (Chang), and International Publication Number WO 2005/107512 A2.

Other belt carrying devices include both an inner and outer belt system, from which containers may be suspended, with the ability for each container to be slid along the outer belt, permitting relative rotational movement between the wearer and each of the containers. Disadvantageously, the containers of such devices must be moved individually which may be time consuming. Additionally, due to the buckles for such belts, a full 360-degree rotation about the wearer is not possible. Examples of such devices include U.S. Pat. No. 5,722,576 (Rogers) and US Patent Application Publication No. 2016/0051037 A1 (Ballard).

SUMMARY OF THE INVENTION

According to a first embodiment of the present invention there is disclosed an apparatus for suspending a plurality of articles from a user having a torso comprising a belt securable around a mid torso of the user and an inner stationary flexible member suspended beneath the belt and extending completely around a lower torso of the user. The apparatus further comprises an outer rotary flexible member suspended from and rotatable about the inner stationary flexible member, the outer rotary flexible member extending at least partially around the torso of the user and being operable to attach a plurality of objects thereto.

The inner stationary flexible member may comprise an elongate flexible inner strap oriented around the lower torso of the user along a plane perpendicular to an axis through the torso. The elongate flexible inner strap may be formed of a plastic.

The inner stationary flexible member may include a plurality of rigid inner clip segments secured thereto wherein the outer rotary flexible member may be supported on the plurality of rigid inner clip segments. Each of the plurality of rigid inner clip segments may include at least one outer wall extending parallel to the elongate flexible inner strap. The at least one outer wall may comprise a pair of coplanar vertically spaced apart outer walls. The pair of coplanar vertically spaced apart outer walls may extend to free distal ends at opposite ends thereof. The plurality of rigid inner clip segments may include an inner wall extending parallel to the elongate flexible inner strap and wherein the inner wall may be spaced apart from the pair of coplanar vertically spaced apart outer walls. The plurality of rigid inner clip segments may include at least one back wall extending parallel to the inner wall. The at least one back wall may comprise a pair of coplanar vertically spaced apart back walls. The pair of coplanar vertically spaced apart back walls may extend to free distal ends at proximate ends thereof. The elongate flexible inner strap may be located between the inner wall and the at least one back wall. The plurality of rigid inner clip segments may be evenly spaced around the elongate flexible inner strap with a gap distance therebetween.

The outer rotary flexible member may comprise an elongate flexible outer strap oriented around and rotatably movable about the lower torso of the user along a plane perpendicular to an axis through the torso. The outer rotary flexible member may include a plurality of outer clip segments secured thereto adapted to engage upon the at least one outer wall of the plurality of rigid inner clip segments. Each of the plurality of outer clip segments may include u-shaped walls adapted to slidably surround top and bottom edges of the at least one outer wall of the plurality of rigid inner clip segments. The plurality of outer clip segments may be secured to the elongate flexible outer strap in a plurality of groups distributed therearound. The plurality of groups may have outer gap distances between them operable to support at least one of the plurality of objects attached thereon.

Each of the plurality of objects may comprise a clip selectably securable over the outer rotary flexible member.

The apparatus may further comprise a harness secured to the belt and adapted to extend over the shoulders of a user.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
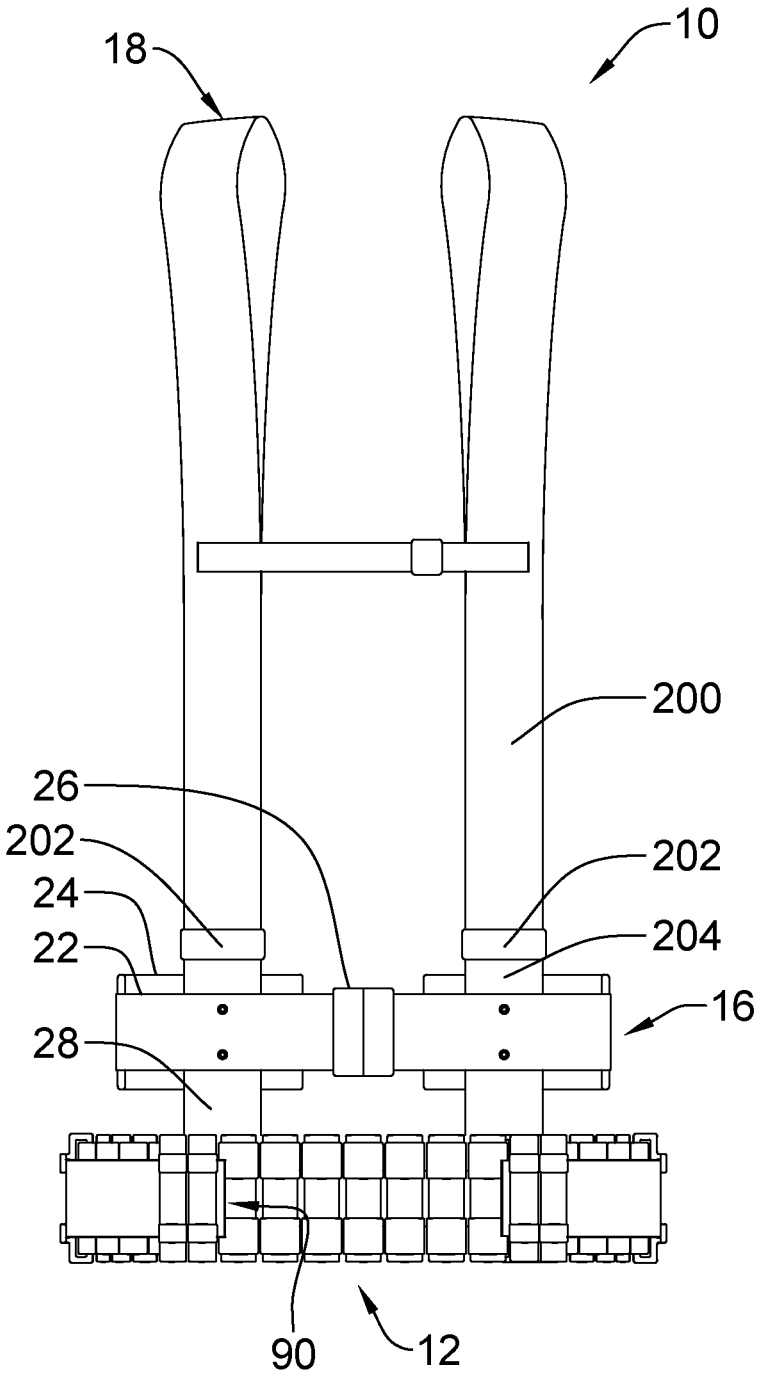
FIG. 1 is a front view of a system including a harness and belt assembly carrying apparatus according to the first embodiment of the present invention.
Figure 2:
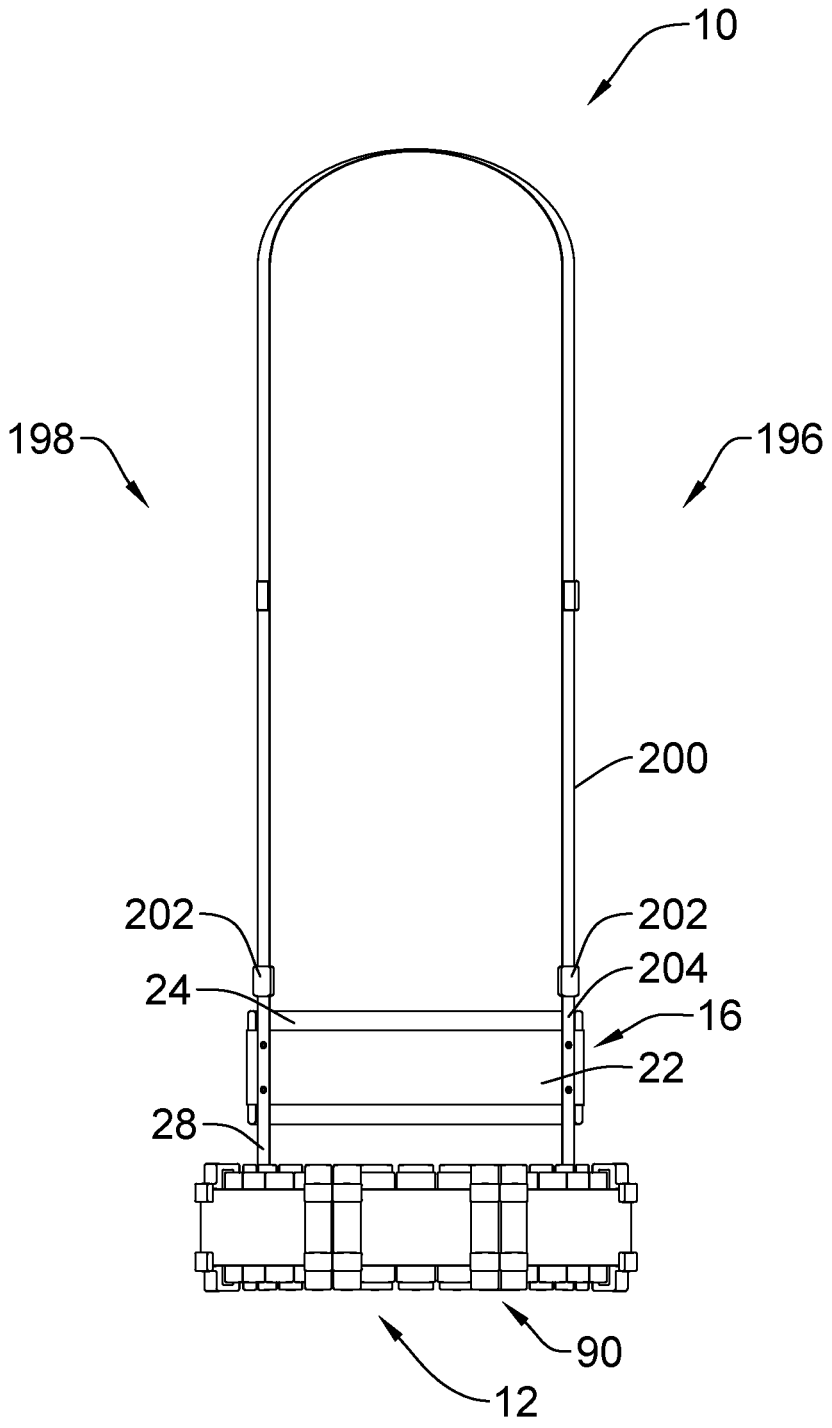
FIG. 2 is a side view of the system of FIG. 1.

Referring to FIGS. 1 and 2, a system for carrying a plurality of articles on a user according to a first embodiment of the invention is shown generally at 10. The system 10 may be used to carry a variety of items, including, by way of non-limiting example, photography equipment such as camera bodies, lenses, tripods, filters, flash bodies, etc. It may be appreciated that other items may be carried within the containers, as well. The system 10 comprises a harness assembly 18 securable to a wearer supporting a waist belt 16 and belt assembly 12, with a rotatable outer belt 90 rotatable thereabout.

The system 10 includes a belt assembly 12 around the user's lower torso (hips), supported by a waist belt 16 around the user's mid torso (waist). The waist belt 16 is secured to the torso of a user and remains stationary on the user's body while the attached belt assembly 12 may allow a full 360-degree rotation of the rotatable outer belt 90 around the user's lower torso (hips), as will be described in more detail below.

The waist belt 16 comprises an elongate strap 22, securable about a user's torso, with an adjustable closure mechanism 26. The elongate strap 22 may be constructed using, such as by way of non-limiting example, polyester webbing, or any other suitable material, such that it is flexible and may fully encircle the user's waist. The adjustable closure mechanism 26 may be, such as, by way of non-limiting example, a quick release buckle, as is commonly known, allowing for the waist belt 16 to be opened or closed, and additionally allowing for length adjustment of the elongate strap 22, to adjust to the waist size of various users. It will be appreciated that other closure mechanisms and length adjustment methods may be useful, as well. Optional attached padded material 24 secured to an inside surface of the waist belt strap may improve comfort for the user and may be constructed using, such as by way of non-limiting example, padded nylon fabric. The padded material 24 may be formed in a plurality of pieces to span the side waist areas of the user, or it may be formed in a single piece, spanning any length along the waist belt 16. The optional padded material 24 may be attached to the elongate strap 22 by any known means, such as, by way of non-limiting example, sewn with thread, rivets, snaps, hook and loop fasteners, or any other known fasteners.

A plurality of suspension straps 28 are suspended from the waist belt 16, distributed therearound. The suspension straps 28 join the waist belt 16 with the belt assembly 12. The suspension straps 28 may be made using any suitable material, such as, by way of non-limiting example, polyester webbing, and are secured to the waist belt 16 by any known means, such as, by way of non-limiting example, thread, rivets, snaps, hook and loop fasteners, or any other known fasteners. The suspension straps 28 are attached to the belt assembly 12 such that the belt assembly 12 may be supported by the waist belt.

Figure 3:
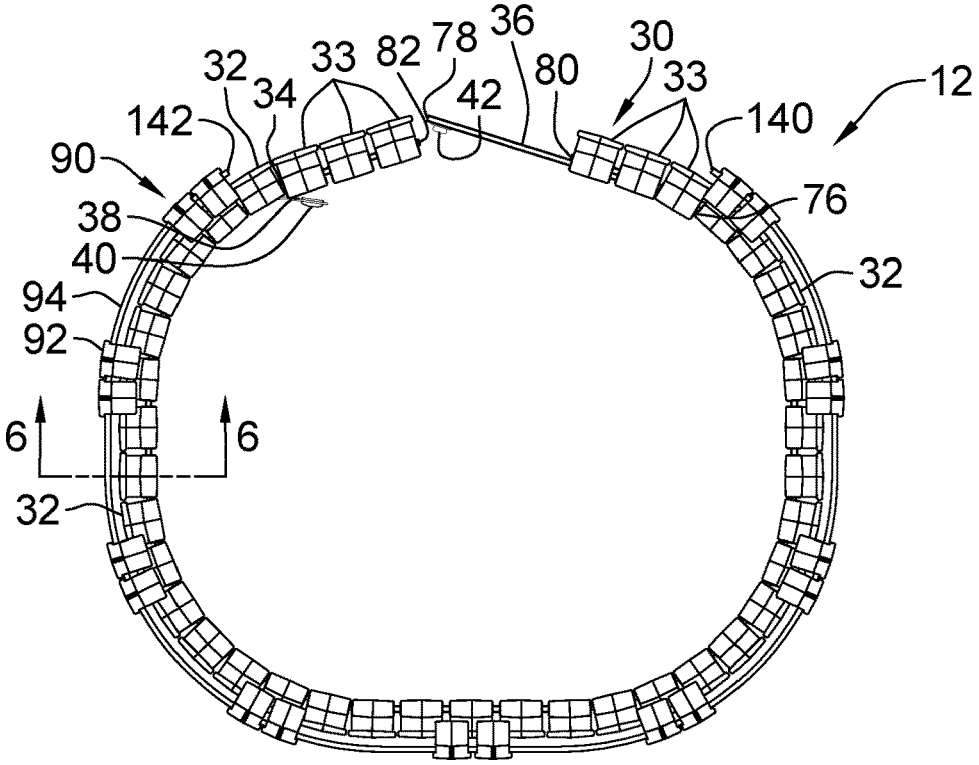
FIG. 3 is a top plan view of the belt assembly of FIG. 1, with the inner belt open.
Figure 4:
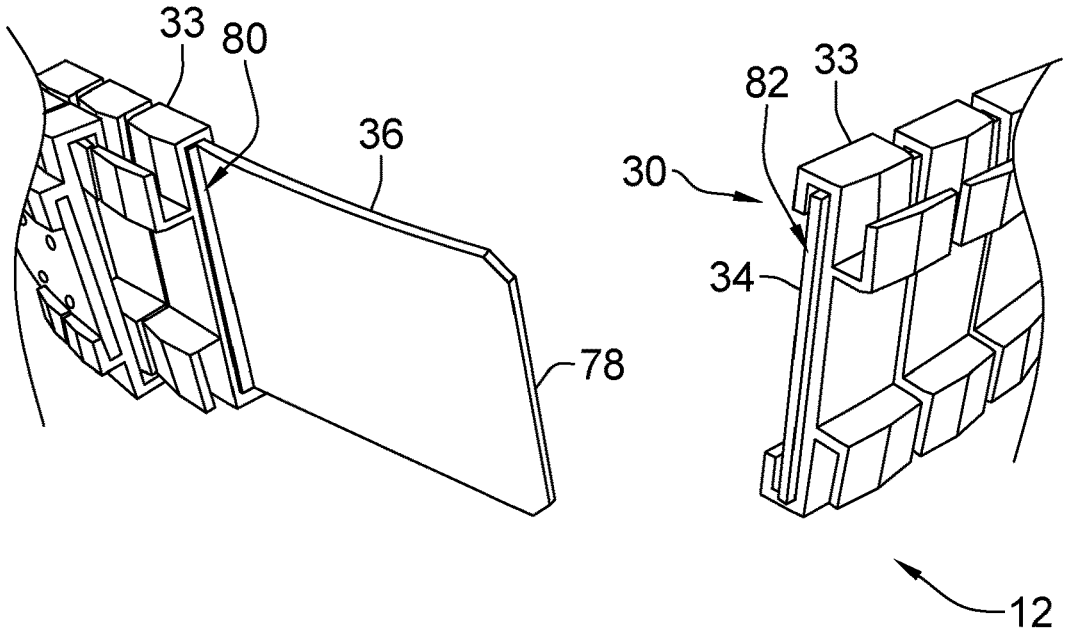
FIG. 4 is a perspective partial view of belt assembly of FIG. 1, with the inner belt open.
Figure 5:
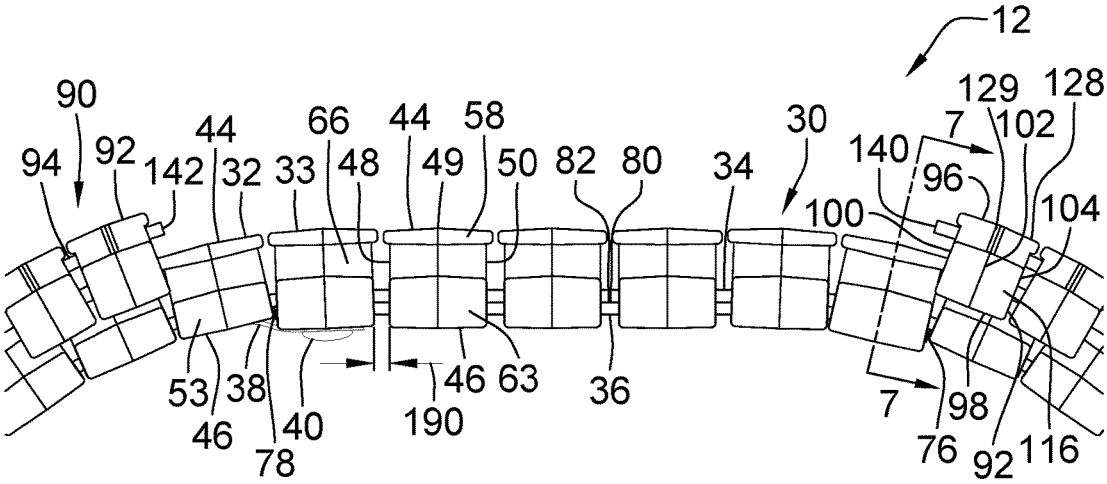
FIG. 5 is an enlarged detail top plan view of the belt assembly of FIG. 1, with the inner belt closed.

Turning now to FIG. 3, the belt assembly 12 includes a stationary inner belt 30 suspended from the suspension straps 28 and a rotatable outer belt 90. The stationary inner belt 30 is comprised of a plurality of inner belt clip segments 32 and connecting inner belt clip segments 33 secured to an inner belt strap 34, extending between first and second ends, 80 and 82, respectively. The connecting inner belt clip segments 33 are located proximate to the first and second ends, 80 and 82, while the inner belt clip segments 32 are distributed around the remainder of the stationary inner belt 30. In the current embodiment of the invention, there are three connecting inner belt clip segments 33 at the first end 80 and three connecting inner belt clip segments 33 at the second end 82, although it will be appreciated that more or less connecting inner belt clip segments 33 may be useful, as well. As seen in FIGS. 3, 4 and 5, an inner belt tongue 36 extends from the first end 80 and is receivable within a connecting inner belt clip segment 33 of the stationary inner belt 30 proximate to the second end 82. An inner belt connecting strap 38, shown on FIGS. 3 and 5, is secured to an inner belt clip segment 32 proximate to the first end 80 and includes a first connector 40 mateable with a second connector 42 secured to the inner belt tongue 36. The present embodiment of the invention is illustrated with first and second connectors, 40 and 42, respectively, as a snap, as is commonly known, but it may be appreciated that other reclosable fastener methods may be useful, as well, such as, by way of non-limiting example, hook and loop fasteners.

Figure 6:
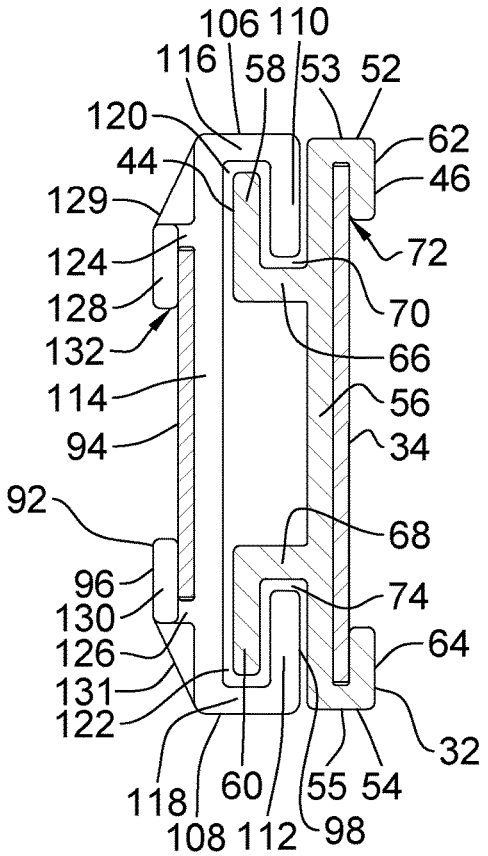
FIG. 6 is a cross sectional view of the belt assembly of FIG. 1, taken along the line 6-6 of FIG. 3.
Figure 7:
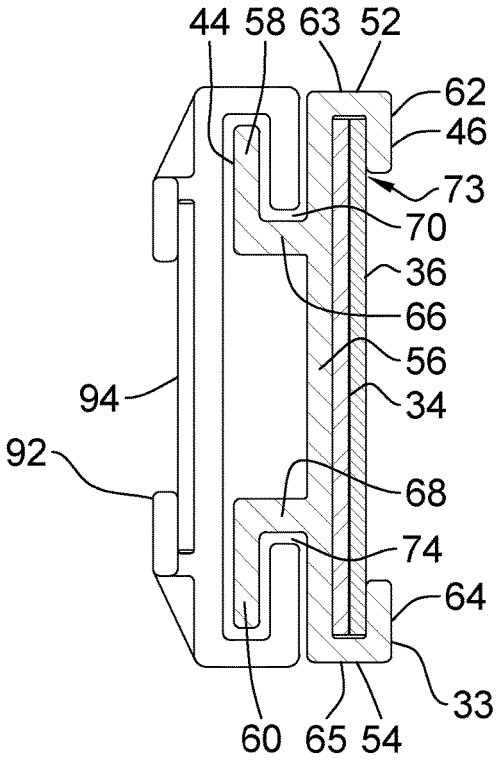
FIG. 7 is a cross sectional view of the belt assembly of FIG. 1, taken along the line 7-7 of FIG. 5.

As best seen on FIGS. 5, 6 and 7, each inner belt clip segment 32 and connecting inner belt clip segment 33 extends between the front and rear surfaces, 44 and 46, respectively, between the first and second side edges, 48 and 50, respectively, with a midpoint 49 therebetween, and between the top and bottom, 52 and 54, respectively. An inner wall 56 extends between the top and bottom, 52 and 54, respectively. On the inner belt clip segment 32, as illustrated in FIG. 6, upper and lower connecting walls 53 and 55, respectively, extending from the inner wall 56 along the top and bottom, 52 and 54, respectively, to the rear surface 46. Turning now to FIG. 7, each connecting inner belt clip segment 33 is formed in the same manner as an inner belt segment 32, with upper and lower connecting walls 63 and 65, respectively, which extend a greater distance from the inner wall 56 to the rear surface 46, the purpose of which will be set out below. Upper and lower back walls 62 and 64, respectively, extend from the top and bottom 52 and 54, respectively, and define the rear surface 46 between the first and second side edges, 48 and 50, and partially between the top and bottom, 52 and 54, forming a gap therebetween. The upper and lower back walls 62 and 64 and upper and lower connecting walls, 53, 63, and 55, 65, may be tapered from the midpoint 49 to the first and second side edges, 48 and 50, as illustrated on FIG. 5, such that the upper and lower back walls 62 and 64 and the upper and lower connecting walls, 53, 63 and 55, 65 may have a wider profile at the midpoint 49, with a taper angle such as, by way of non-limiting example, between 1 and 3 degrees. Upper and lower front walls, 58 and 60, respectively, extend along and define the front surface 44 between the first and second side edges, 48 and 50, and substantially between the top and bottom, 52 and 54, with a gap therebetween, as shown in FIGS. 6 and 7. As best seen in FIG. 5, the upper and lower front walls, 58 and 60, may be tapered from the midpoint 49 to the first and second side edges, 48 and 50, such that the upper and lower front walls, 58 and 60, may have a wider profile at the midpoint 49, with a taper angle such as, by way of non-limiting example, between 1 and 3 degrees. The upper and lower front walls, 58 and 60, may have a wider profile between the first and second side edges, 48 and 50, than the upper and lower back walls 62 and 64. Referring now to FIGS. 6 and 7, it will be appreciated that where fasteners such as, by way of non-limiting example, rivets are used to secure clip segments 32 and 33 to the inner belt strap 34 as well as the outer belt clip segments 92 to the outer belt strap 94, the gap between the upper and lower front walls 58 and 60 will be required to permit access thereto as well as to prevent such fasteners from contacting each other and thereby resisting the motion of their respective belts relative to each other.

Referring to FIG. 6, the upper and lower connecting walls 53 and 55, together with the upper and lower back walls 62 and 64 and the inner wall 56 form a cavity 72 sized to retain the inner belt strap 34 therein. Turning now to FIG. 7, the upper and lower connecting walls 63 and 65 are sized such that a cavity 73 is formed between the upper and lower back walls 62 and 64 and the inner wall 56, which is sized to retain both the inner belt strap 34 and the inner belt tongue 36 therein. It will also be appreciated that the length of the upper and lower back walls 62 and 64 should be selected to retain the inner belt tongue 36 when it is inserted in the cavity 73. Upper and lower connecting walls, 66 and 68, respectively, extend substantially between the first and second side edges, 48 and 50, and between the upper and lower front walls, 58 and 60, and the inner wall 56, forming top and bottom gaps, 70 and 74, therebetween. The top and bottom gaps, 70 and 74, are sized to receive portions of the rotatable outer belt 90 therein, as will be described in more detail below. Each inner belt clip segment 32 and connecting inner belt clip segment 33 may be formed of any suitable material, such as, by way of non-limiting example, injection molded plastics, nylon or the like.

The flexible elongate inner belt strap 34, extending between first and second ends, 80 and 82, respectively, is sized to extend fully around a user's hips, and spaced apart therefrom when in use. It may be appreciated that a variety of inner belt strap 34 lengths may be useful, to allow for various sizes of users. The inner belt strap 34 may be constructed using such as, by way of non-limiting example, 3/32 inch (2.4 mm) thick by 3 inch (76 mm) wide nylon material, however other materials and sizes may be useful, as well. As set out above, the inner belt strap 34 extends through a plurality of inner belt clip segments 32 and connecting inner belt clip segments 33, within the cavities 72 and 73, such that the inner belt strap 34 engages upon the inner wall 56 between the upper and lower connecting walls, 53, 63 and 55, 65. The inner belt strap 34 is fastened to the inner wall 56 of each inner belt clip segment 32 and connecting inner belt clip segment 33 by any known means, such as, by way of non-limiting example, rivets or adhesive. The plurality of inner belt clip segments 32 and connecting inner belt clip segments 33 are evenly spaced apart along the full length of the inner belt strap 34, as outlined above, allowing a gap distance 190 therebetween the first and second side edges 48 and 50 of adjacent inner belt clip segments 32 or connecting inner belt clip segments 33 at the inner walls 56 such as in the range of between 1/8 inches and 1/4 inches (3 mm and 6 mm), by way of non-limiting example, to allow the stationary inner belt 30 to flexibly encircle a user without interference between the inner belt clip segments 32 and connecting inner belt clip segments 33 whether on a straight or curved portion of the wearer's torso.

The inner belt tongue 36, extending between first and second ends, 76 and 78, respectively, may be constructed using similar material, and may be similar in thickness and width, to the inner belt strap 34, and may extend approximately 3-6 inches (75-150 mm) in length, although other lengths may be useful, as well. As shown in FIGS. 3 and 4, the inner belt tongue 36 extends past the first end 80 of the inner belt strap 34, with the first end 76 secured to the stationary inner belt 30 within the cavity 73 of the connecting inner belt clip segment 33 located proximate to the first end 80 of the inner belt strap 34. The inner belt tongue 36 may be fastened to the inner belt strap 34 or to the connecting inner belt clip segment 33 by any known means, such as, by way of non-limiting example, rivets or adhesive.

To close the stationary inner belt 30 for use, the second end 78 of the inner belt tongue 36 may be slidably inserted into the stationary inner belt 30 through the cavities 73 of the connecting inner belt clip segments 33 proximate to the second end 82 of the inner belt strap 34. The inner belt tongue 36 is illustrated in FIG. 5 with the first end 76 secured within one connecting inner belt clip segment 33 proximate to the first end 80 of the inner belt strap 34 and passing the connecting inner belt clip segments 33 proximate to the second end 82 of the inner belt strap 34, such that the first and second ends, 80 and 82, of the inner belt strap 34 are positioned in close proximity to one another. It may be appreciated that the inner belt tongue 36 may pass through more or less connecting inner belt clip segments 33 than is illustrated in the present embodiment of the invention depending upon the width of the connecting inner belt clip segments 33 and the length of the inner belt tongue 36.

The stationary inner belt 30 may be secured in the closed position, as shown in FIG. 5, using the inner belt connecting strap 38 with the first and second connectors, 40 and 42, as set out above. The inner belt strap 34 is sized such that when the first and second connectors, 40 and 42, are mated, the distance between the two connecting inner belt clip segments 33 located at distal ends of the inner belt strap 34 are spaced a distance apart that matches the spacing of all inner belt clip segments 32 and connecting inner belt clip segments 33 on the stationary inner belt 30.

As set out above, the belt assembly 12 may be supported by the waist belt 16, and is connected with a plurality of suspension straps 28, secured to the waist belt 16 and to the inside of the stationary inner belt 30 by any known means, spaced apart to match the spacing of the suspension straps 28 on the waist belt 16.

Referring to FIG. 3, the rotatable outer belt 90 is comprised of a plurality of outer belt clip segments 92 secured to an outer belt strap 94, extending between first and second ends 140 and 142, respectively. As best seen on FIGS. 5 and 6, each outer belt clip segment 92 extends between the front and rear surfaces, 96 and 98, respectively, between the first and second side edges, 100 and 104, respectively, with a midpoint 102 therebetween, and between the top and bottom, 106 and 108, respectively. Back top and bottom ridges, 110 and 112, respectively, extend at the rear surface 98 from the top and bottom, 106 and 108, and between the first and second side edges, 100 and 104, and are sized to be slidably received within the top and bottom gaps, 70 and 74, of an inner belt clip segment 32 or a connecting inner belt clip segment 33. An upstanding wall 114 extends between the top and bottom, 106 and 108, and between the first and second side edges, 100 and 104, and is spaced apart from the back top and bottom ridges, 110 and 112, by upper and lower connecting walls, 116 and 118, respectively, such that inner top and bottom gaps, 120 and 122, respectively, are formed therebetween, sized to slidably receive the upper and lower front walls, 58 and 60, of an inner belt clip segment 32 or connecting inner belt clip segment 33. Upper and lower connecting walls, 124 and 126, respectively, extend from the upstanding wall 114 to the front surface 96 of the outer belt clip segment 92, between first and second side edges, 100 and 104, with top and bottom ridges, 128 and 130, respectively, extending from the distal ends thereof, forming a front gap 132, therebetween. As best seen on FIG. 5, the top and bottom ridges, 128 and 130, may be tapered from the midpoint 102 to the first and second side edges, 100 and 104, with a taper angle such as, by way of non-limiting example, between 1 and 3 degrees, such that the top and bottom ridges, 128 and 130, may have a wider profile at the midpoint 102 than at the first and second side edges, 100 and 104. The top and bottom ridges, 128 and 130, may have a longer profile between the first and second side edges, 100 and 104, than the upper and lower connecting walls, 124 and 126. As seen on FIG. 6, the front gap 132 is sized to receive the outer belt strap 94 therein. Upper and lower ribbing, 129 and 131, respectively, may extend between the top and bottom ridges, 128 and 130, and the upper and lower connecting walls, 116 and 118, proximate to the midpoint 102 to improve stiffness of the outer clip segment 92.

The flexible elongate outer belt strap 94, extending between first and second ends, 140 and 142, respectively, is sized to partially extend around the stationary inner belt 30, as best illustrated in FIG. 3. The outer belt strap 94 may be constructed using such as, by way of non-limiting example, 3/32 inch (2.4 mm) thick by 2 inch (51 mm) wide nylon material, however other materials and sizes may be useful, as well. As set out above, the outer belt strap 94 extends through a plurality of outer belt clip segments 92, within the front gap 132, such that the outer belt strap 94 engages upon the upstanding wall 114 and upon the top and bottom ridges, 128 and 130. The outer belt strap 94 is fastened to each outer belt clip segment 92 by any known means, such as, by way of non-limiting example, rivets or adhesive. The plurality of outer belt clip segments 92 are spaced apart along the full length of the outer belt strap 94 in groups of three, or as in groups of two, as best seen on FIG. 3, although it may be appreciated that other quantities may be useful, as well. The two proximate outer belt clip segments 92 are spaced apart allowing a distance therebetween the first and second side edges 100 and 104 of adjacent outer belt clip segments 92 such as in the range of between 3/32 inches and 7/32 inches (3 mm and 6 mm), by way of non-limiting example, with each group of outer belt clip segments 92 spaced apart such as in the range of 2 inches to 2½ inches (52 mm to 63 mm), by way of non-limiting example, although other spacing distances may be useful, as well, to allow for one or more containers to be attached to the outer belt strap 94, as will be set out in more detail below.

Figure 8:
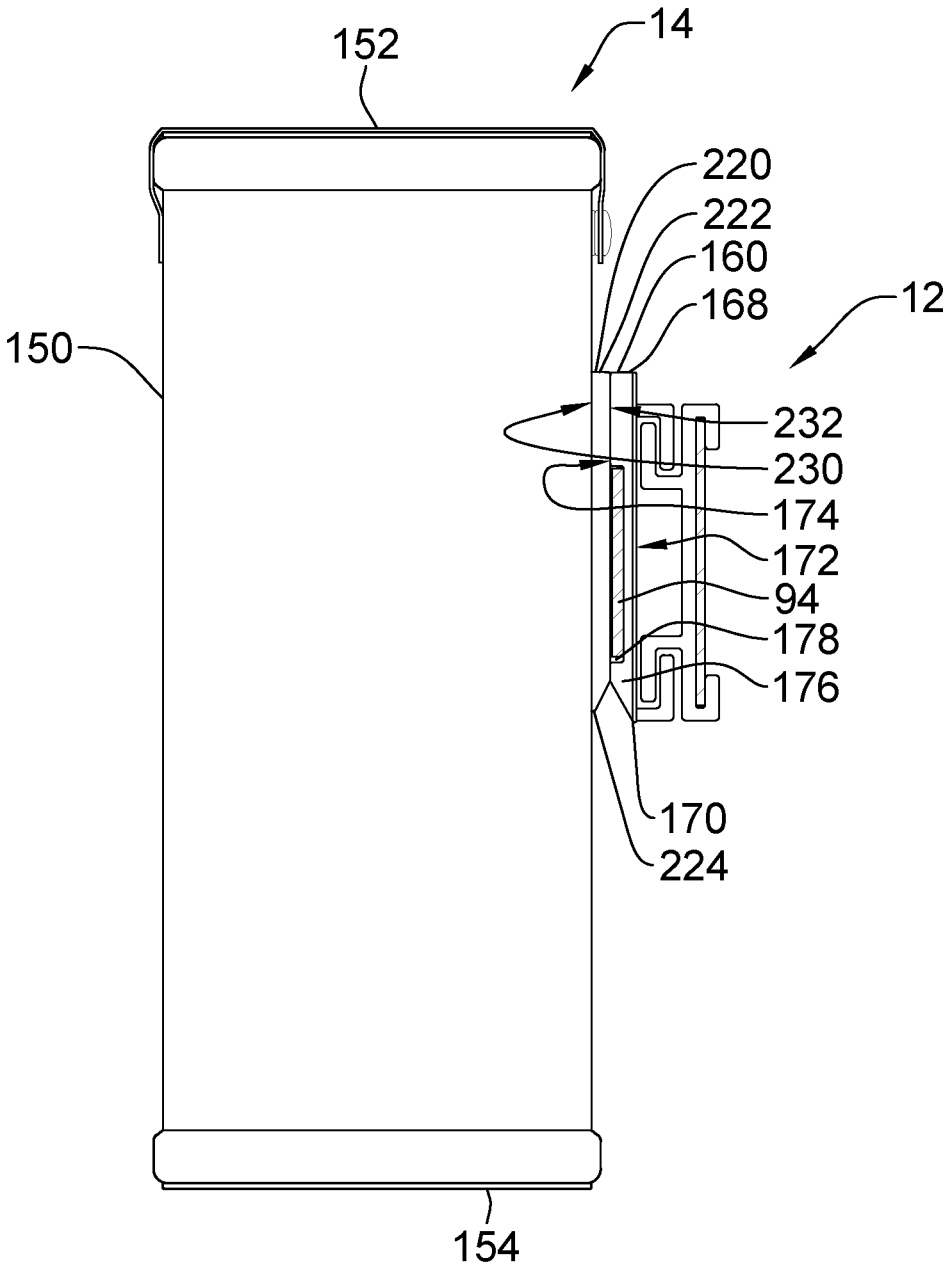
FIG. 8 is a side view of a clip on a container attached to the belt assembly of FIG. 1.

Turning now to FIG. 8, a container 14 attached to the belt assembly 12 is illustrated. The container 14 includes a body 150, extending between the top and bottom edges, 152 and 154, respectively. A spacer block 220 and a plurality of container attachment clips 160 may be simultaneously secured to the body 150 by any known means, such as, by way of non-limiting example, rivets or adhesive, although it may be appreciated that other attachment methods may be useful, as well.

Figure 9:
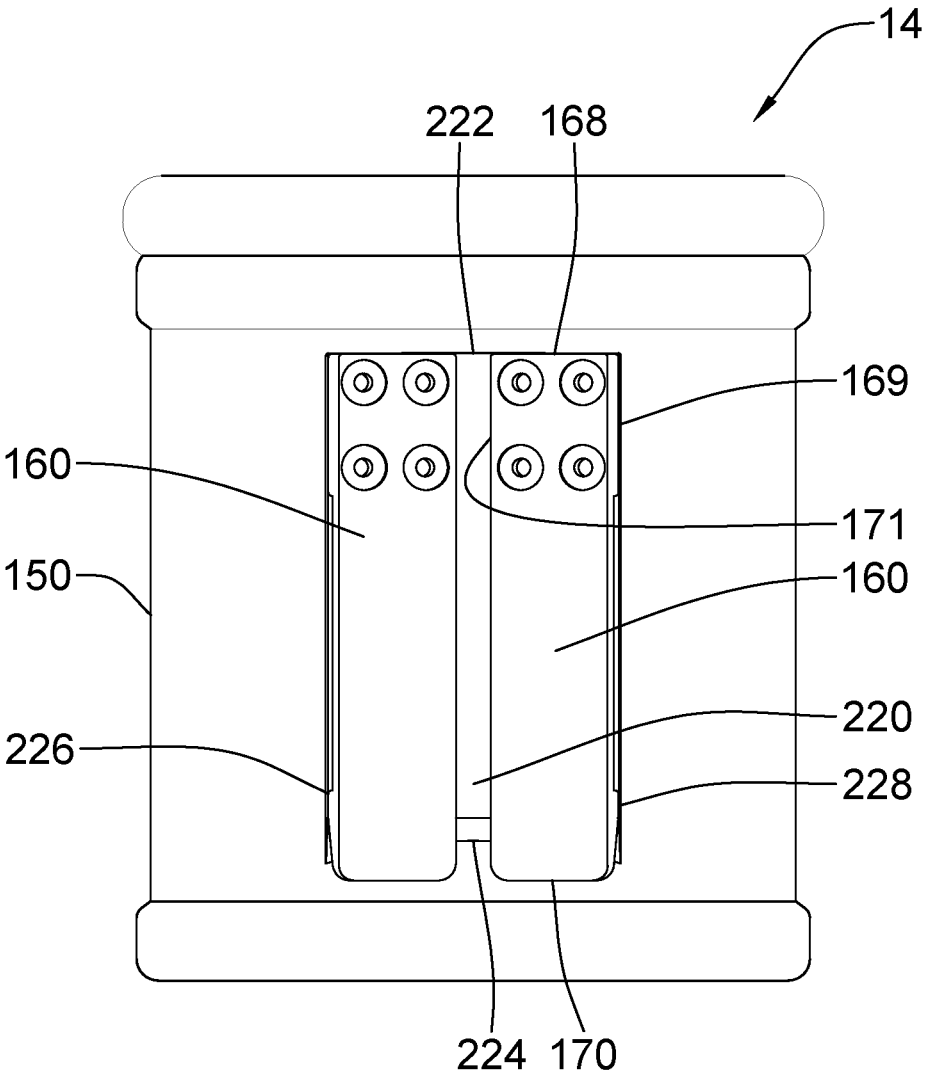
FIG. 9 is a back view of the clip on a container of FIG. 8, attached to the belt assembly of FIG. 1.

Referring to FIGS. 8 and 9, the spacer block 220 is located between the plurality of at least one attachment clip 160 and the container body 150 and extends between top and bottom edges, 222 and 224, respectively, first and second side edges, 226 and 228, respectively, with inside and outside surfaces, 230 and 232, respectively. The spacer block 220 may be constructed using such as, by way on non-limiting example, ABS injection molded plastic, although other materials and methods of construction may be useful as well. The plurality of at least one attachment clips 160 extends between the top 168 and bottom 170, respectively, and between first and second side edges, 169 and 171, respectively, with outside and inside surfaces, 172 and 174, respectively, and is simultaneously secured to the spacer block 220 and the body 150, as set out above, proximate to the top 168. A tapered ridge 176 extends from the inside surface 174 proximate to the bottom 170 and engages upon the spacer block 220 such that a gap 178 is formed between the inside surface 174 of the attachment clip 160 and the spacer block 220. The tapered ridge 176 is sized and positioned such that the gap 178 may receive, and the inside surface 174 of the attachment clip 160 may engage upon, the outer belt strap 94 of the belt assembly 12.

Figure 10:
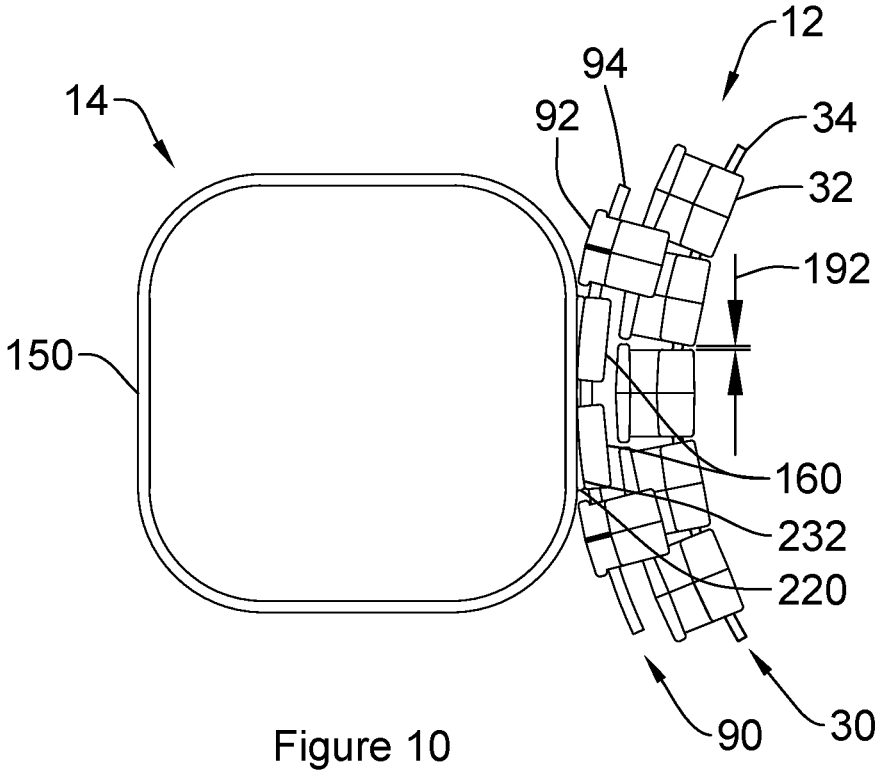
FIG. 10 is a top plan view of the clip on a container of FIG. 8 attached to the belt assembly of FIG. 1 in a curved belt configuration.
Figure 11:
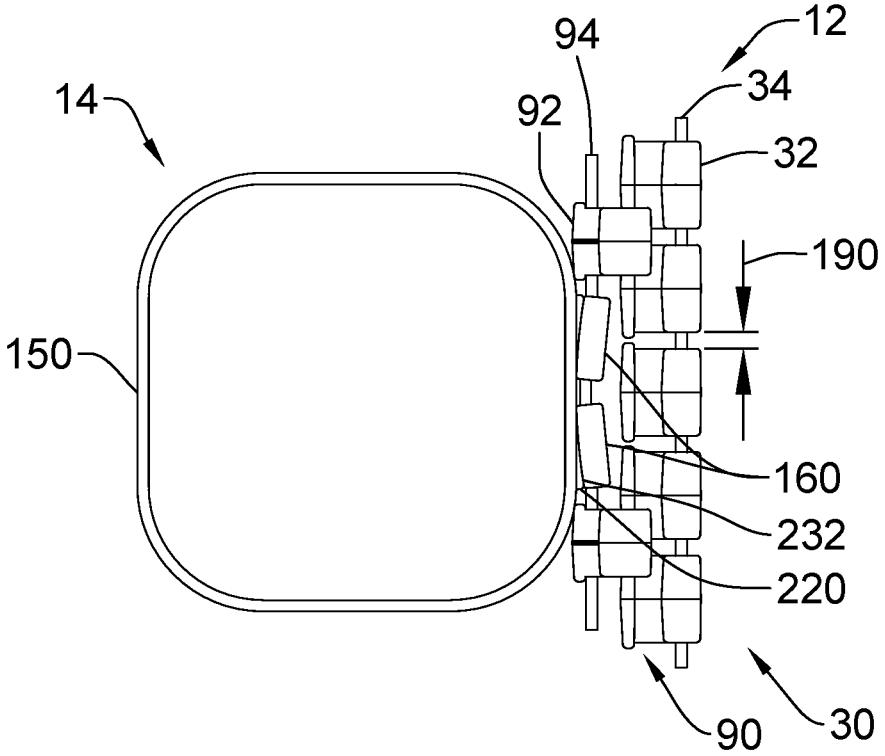
FIG. 11 is a top plan view of the clip on a container of FIG. 8 attached to the belt assembly of FIG. 1 in a straight belt configuration.

Turning now to FIGS. 10 and 11, the plurality of at least one attachment clips 160 engage upon the outer belt strap 94 of the belt assembly 12 between the outer belt clip segments 92. The at least one attachment clip 160 is constructed using such as, by way of non-limiting example, injection molded nylon, although other materials and methods of construction may be useful, as well. As illustrated in FIGS. 10 and 11, the present embodiment of the invention includes two attachment clips 160, although it may be appreciated that more or less attachment clips 160 may be useful, as well. As best seen in FIG. 10, the outside surface 232 of the spacer block 220 may be curved such that when the attachment clips 160 are mounted on the spacer block 220, the attachment clips are angularly aligned with one another, such that the attachment clips 160 may best engage with the outer belt strap 94 when the belt assembly 12 is in the closed position.

Figure 12:
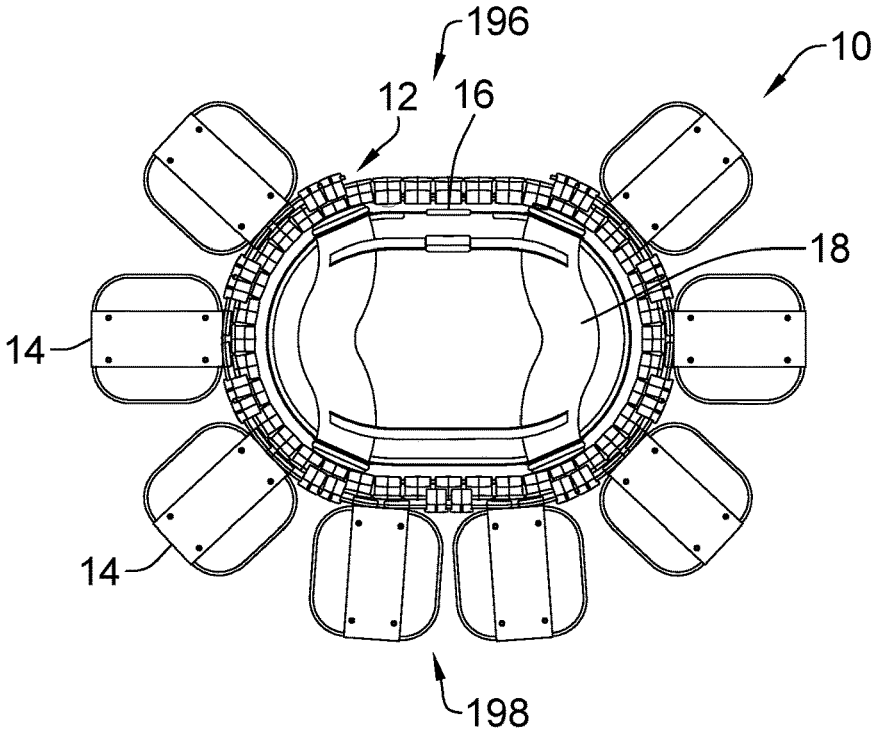
FIG. 12 is a top plan view of the system of FIG. 1, with attached containers in a first or installation position.
Figure 13:
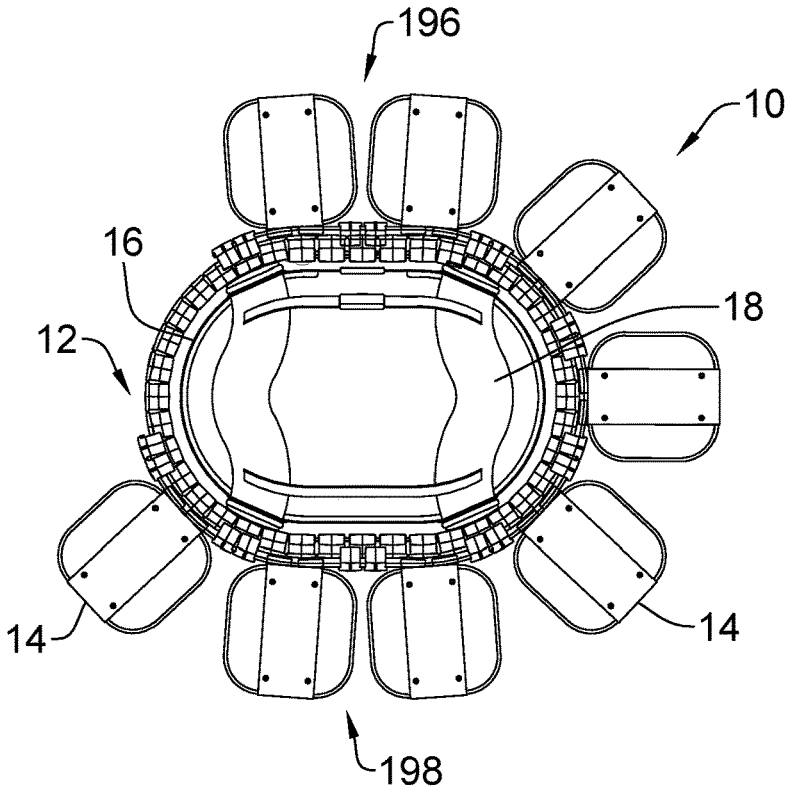
FIG. 13 is a top plan view of the system of FIG. 1, with attached containers in a second or rotated position.

Referring now to FIGS. 10 and 11, a container 14 is shown attached to the belt assembly 12 in both a curved belt configuration and a straight belt configuration. As set out above, the gap distance 190 between the inner belt clip segments 32 is in the range of between ⅛ inches and ¼ inches (3 mm and 6 mm), by way of non-limiting example, as constructed in the straight belt configuration. When the belt assembly 12 is worn by a user, with the stationary inner belt 30 closed, the inner belt strap 34 flexes and will include curved portions, as seen in FIGS. 10, 12 and 13. At the curved portions, the upper and lower back walls 62 and 64 of the inner belt clip segments 32 and connecting inner belt clip segments 33 are spaced apart a reduced gap distance 192, such as in the range of between 1/16 inches and 3/16 inches (1.5 mm and 5 mm), such that the inner belt clip segments 32 and connecting inner belt clip segments 33 do not interfere with each other when in use. As illustrated in FIGS. 10 and 11, the profile of the outside surface 232 of the spacer block 220, which provides the angular orientation of the attachment clips 160 relative to each other, as well as the profile of the outer belt clip segments 92, are such that the rotatable outer belt 90 may smoothly engage with the stationary inner belt 30, without interference between parts in either the straight or curved configuration.

When fully assembled, the belt assembly 12 allows for a plurality of containers 14 to be attached thereon, as best illustrated in FIGS. 12 and 13. To access any container 14 thereon, the rotatable outer belt 90 may be slidably rotated around the user, with the outer belt clip segments 92 engaging with the inner belt clip segments 32 and connecting inner belt clip segments 33 sequentially as the rotatable outer belt 90 is rotated about the user. The rotatable outer belt 90 may be rotated to any position, thereby allowing the user to access all containers.

An optional shoulder harness assembly 18 may be added to the system 10, as illustrated in FIGS. 1 and 2. The shoulder harness assembly 18 is secured to the waist belt 16, allowing weight distribution of the belt assembly 12 over the shoulders and back of the user, in addition to the waist support previously outlined.

The shoulder harness assembly 18 includes two elongate shoulder straps 200, securable over a user's shoulders and torso forming front and rear portions, 196 and 198, respectively, thereof, with adjusting clasps 202 at the distal ends thereof, connecting with a plurality of suspension straps 204 attached to the waist belt 16 therearound. The shoulder straps 200 and suspension straps 204 may be made using any suitable material, such as, by way of non-limiting example, polyester webbing, and the suspension straps 204 are secured to the waist belt 16 by any known means, such as, by way of non-limiting example, thread, rivets, snaps, hook and loop fasteners, or any other known fasteners. The adjusting clasps 202 may be any suitable clasp, as is commonly known, such as, by way of non-limiting example, quick release clasps or buckles, allowing for length adjustment of the shoulder straps 200 to adjust the size of the shoulder harness assembly 18 for various users.

To utilize the system 10 as shown in FIGS. 1 and 2, the shoulder harness assembly 18, waist belt 16 and belt assembly 12 may be connected together with the adjusting clasps 202 as set out above, while the waist belt 16 and the belt assembly 12 are in the open position, as illustrated in FIGS. 3 and 4. The user may don the shoulder harness assembly 18 of the system 10 in a similar manner as a backpack or suspenders are donned, as is commonly known. The shoulder harness assembly 18 may be adjusted for the user's height with the adjusting clasps 202. The waist belt 16 may then be closed and adjusted to the user's waist size with the adjustable closure mechanism 26, and the belt assembly 12 may be closed as outlined above. All containers 14 may be attached to the system 10 at any time. Once the user is wearing the system 10, the plurality of containers 14 attached to the belt assembly 12 may be accessed by rotating the rotatable outer belt 90 around the user's torso, as described above.

While specific embodiments of the invention have been described and illustrated, such embodiments should be considered illustrative of the invention only and not as limiting the invention as construed in accordance with the accompanying claims.

What is claimed is:

1. An apparatus for suspending a plurality of articles from a user having a torso comprising:

a belt securable around a mid torso of the user;

an elongate flexible inner strap suspended beneath said belt and extending completely around a lower torso of said user and oriented around said lower torso of said user along a plane perpendicular to an axis through said torso;

an outer rotary flexible member suspended from and rotatable about said elongate flexible inner strap, said outer rotary flexible member extending at least partially around said torso of the user and being operable to attach a plurality of objects thereto; and a plurality of rigid inner clip segments secured to said elongate flexible inner strap wherein said outer rotary flexible member is supported on said plurality of rigid inner clip segments wherein each of said rigid inner clip segments includes a pair of coplanar vertically spaced apart outer walls extending parallel to said elongate flexible inner strap and extending away from each other to free distal ends at opposite ends thereof.

2. The apparatus of claim 1 wherein said elongate flexible inner strap is formed of a plastic.

3. The apparatus of claim 1 wherein said plurality of rigid inner clip segments are evenly spaced around said elongate flexible inner strap with a gap distance therebetween.

4. The apparatus of claim 1 further comprising a harness secured to said belt and adapted to extend over the shoulders of the user.

5. The apparatus of claim 1 wherein said plurality of rigid inner clip segments include an inner wall extending parallel to said elongate flexible inner strap and wherein said inner wall is spaced apart from said pair of coplanar vertically spaced apart outer walls.

6. The apparatus of claim 5 wherein said plurality of rigid inner clip segments include at least one back wall extending parallel to said inner wall.

7. The apparatus of claim 6 wherein said elongate flexible inner strap is located between said inner wall and said at least one back wall.

8. The apparatus of claim 6 wherein said at least one back wall comprises a pair of coplanar vertically spaced apart back walls.

9. The apparatus of claim 8 wherein said pair of coplanar vertically spaced apart back walls extend to free distal ends at proximate ends thereof.

10. The apparatus of claim 5 wherein said outer rotary flexible member comprises an elongate flexible outer strap oriented around and rotatably movable about said lower torso of said user along said plane perpendicular to an axis through said torso.

11. The apparatus of claim 10 wherein said outer rotary flexible member includes a plurality of outer clip segments secured thereto, each of said plurality of outer clip segments adapted to engage upon said pair of coplanar vertically spaced apart outer walls of said plurality of rigid inner clip segments.

12. The apparatus of claim 11 wherein said each of said plurality of outer clip segments includes u-shaped walls adapted to slidably surround top and bottom edges of said free distal ends of said pair of coplanar vertically spaced apart outer walls of said plurality of rigid inner clip segments.

13. The apparatus of claim 12 wherein said plurality of outer clip segments are secured to said elongate flexible outer strap in a plurality of groups distributed therearound.

14. The apparatus of claim 13 wherein said plurality of groups have outer gap distances between them operable to support at least one of said plurality of objects attached thereon.

15. The apparatus of claim 14 wherein each of said plurality of objects comprises a clip selectably securable over said outer rotary flexible member.

* * * * *